US007200963B1

(12) United States Patent
Vieweg

(10) Patent No.: US 7,200,963 B1
(45) Date of Patent: Apr. 10, 2007

(54) FOLLOWER MAGAZINE SYSTEM

(76) Inventor: Thomas Vieweg, 777 Mount Ave., Wyandanch, NY (US) 11798

( * ) Notice: Subject to any disclaimer, the term of this patent is extended or adjusted under 35 U.S.C. 154(b) by 0 days.

(21) Appl. No.: 11/507,263

(22) Filed: Aug. 21, 2006

Related U.S. Application Data

(63) Continuation of application No. 10/939,868, filed on Sep. 13, 2004, now Pat. No. 7,093,386.

(51) Int. Cl.
*F41A 9/65* (2006.01)
*F41A 9/61* (2006.01)

(52) U.S. Cl. ..... 42/49.01; 42/7

(58) Field of Classification Search ..... 42/6, 42/7, 49.01, 49.02, 49.1, 50
See application file for complete search history.

(56) References Cited

U.S. PATENT DOCUMENTS 3,377,732 A * 4/1968 Bivens ..... 42/50
4,397,109 A * 8/1983 Pachmayr et al. ..... 42/50
4,495,720 A * 1/1985 Bross ..... 42/7
4,592,160 A * 6/1986 Bross ..... 42/7
4,805,333 A * 2/1989 Doria et al. ..... 42/50
4,831,761 A * 5/1989 Kulakow ..... 42/50
5,666,752 A * 9/1997 Grams ..... 42/49.02
6,481,136 B1 * 11/2002 Fitzpartick ..... 42/50
6,698,127 B2 * 3/2004 Weber ..... 42/71.02
6,748,689 B2 * 6/2004 Fitzpatrick ..... 42/50
6,883,261 B2 * 4/2005 Fitzpatrick ..... 42/50

* cited by examiner

*Primary Examiner*—Michael J. Carone
*Assistant Examiner*—Bret Hayes
(74) *Attorney, Agent, or Firm*—Edward P. Dutkiewicz

(57) ABSTRACT

A case has a base end with a base plate and an open upper end thereby forming an interior recess. A spring has an upper end and a lower end positioned on the base plate. A follower is fabricated of metal with a polytetrafluoroethylene coating positioned within the recess upon the spring and with a central section having a downwardly extending front leg and a downwardly extending rear leg. The lower end of the rear leg has a 180 degree bend with an upwardly extending portion terminating in an inwardly extending portion overlying the central portion with a supplemental bend between the upwardly extending portion and the inwardly extending portion.

5 Claims, 5 Drawing Sheets

FIG 1
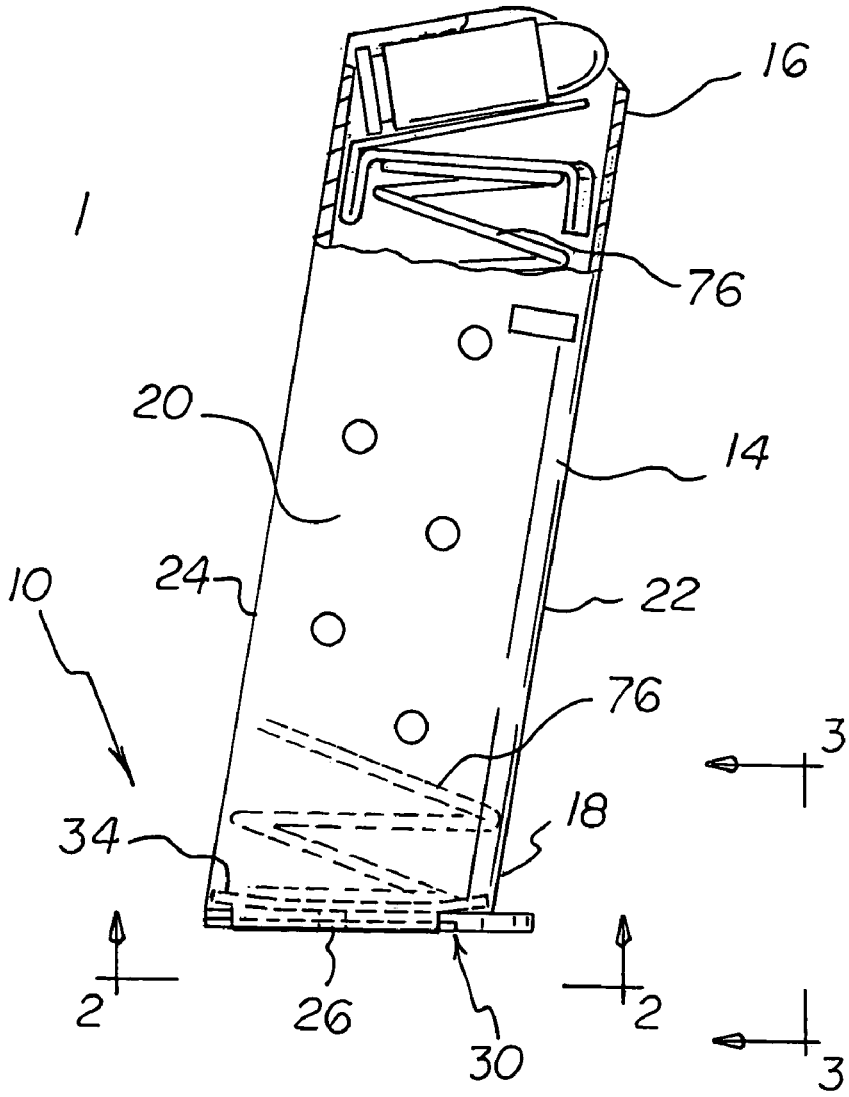
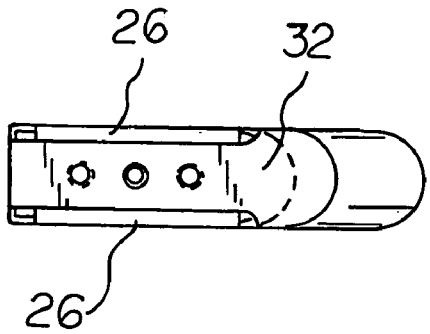
FIG 2

FIG 3
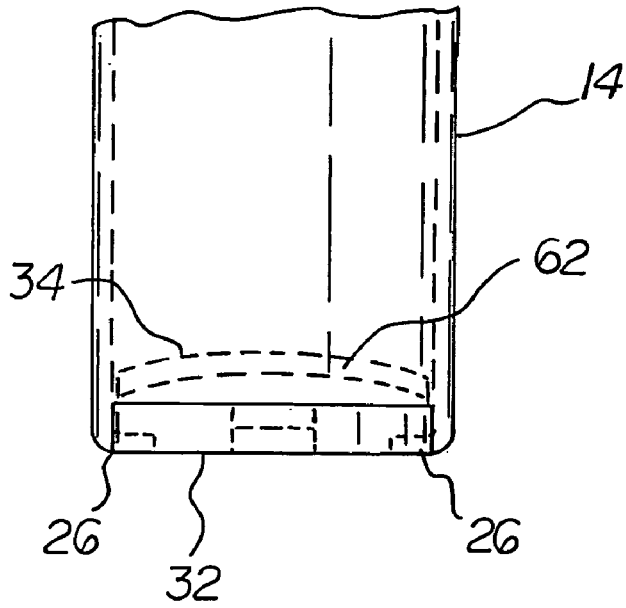
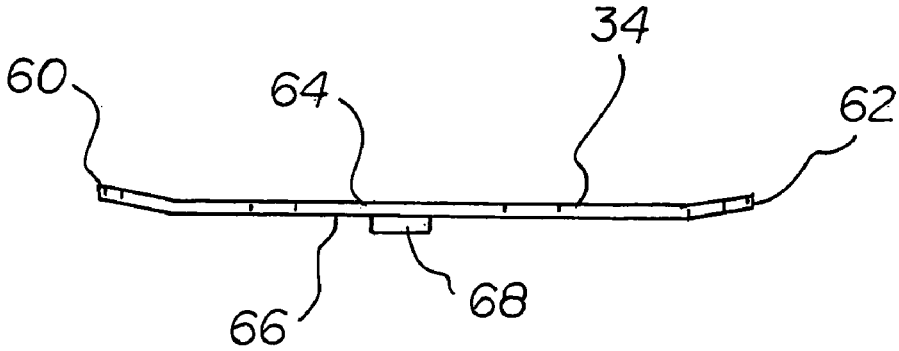
FIG 4

FIG 5
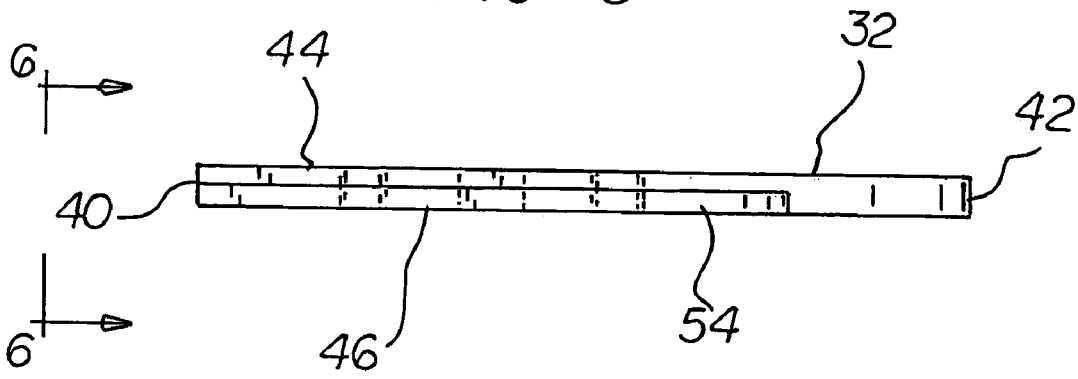
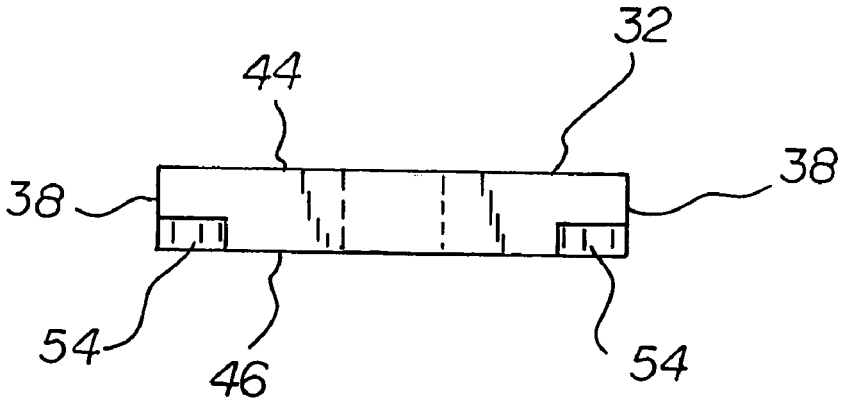
FIG 6

FIG 8
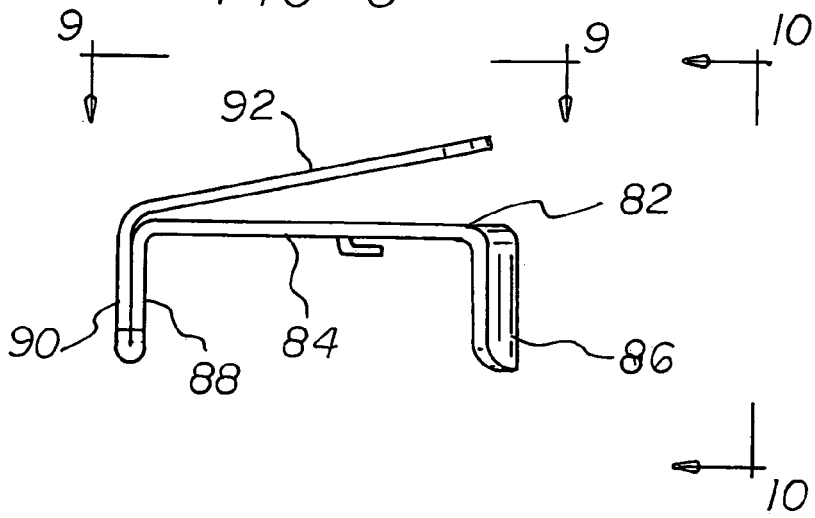
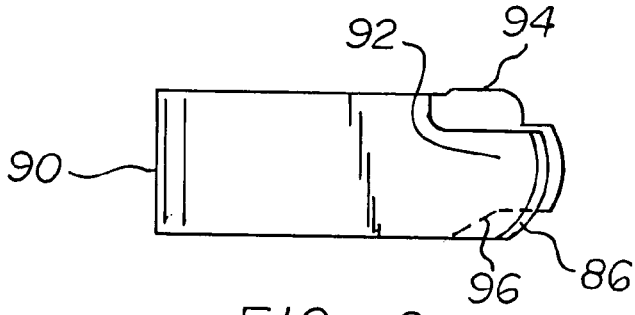
FIG 9
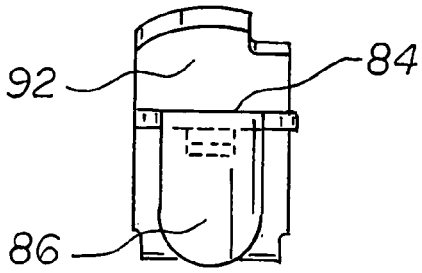
FIG 10

FOLLOWER MAGAZINE SYSTEM

RELATED APPLICATION

The present application is a continuation-in-part of U.S. patent application Ser. No. 10/939,868 filed Sep. 13, 2004, now U.S. Pat. No. 7,093,386 B1, the subject matter of which is incorporated by reference herein.

BACKGROUND OF THE INVENTION

1. Field of the Invention

The present invention relates to a follower magazine system and more particularly pertains a pistol of the type having a barrel and a trigger and a handle for fully receiving a follower magazine system.

2. Description of the Prior Art

The use of magazine systems of known designs and configurations is known in the prior art. More specifically, magazine systems of known designs and configurations previously devised and utilized for the purpose of receiving a follower magazine system through known methods and apparatuses are known to consist basically of familiar, expected, and obvious structural configurations, notwithstanding the myriad of designs encompassed by the crowded prior art which has been developed for the fulfillment of countless objectives and requirements.

By way of example, U.S. Pat. No. 5,099,595 to Chesnut issued Mar. 31, 1992 relates to a Magazine for a Firearm. U.S. Pat. No. 5,438,783 to Sniezak issued Aug. 8, 1995 relates to a Butt Plate Assembly for Handgun Magazines. U.S. Pat. No. 5,526,600 to Chesnut issued Jun. 18, 1996 relates to a Cartridge Magazine Capacity Extender. Lastly, U.S. Pat. No. 5,642,582 to Grams issued Jul. 1, 1997 relates to a Base Pad for a Hand Gun Magazine.

While these devices fulfill their respective, particular objectives and requirements, the aforementioned patents do not describe a follower magazine system that specifically allows for its use with a pistol of the type having a barrel and a trigger as well as a handle for fully receiving the follower magazine system.

In this respect, the follower magazine system according to the present invention substantially departs from the conventional concepts and designs of the prior art, and in doing so provides an apparatus primarily developed for the purpose of use with a pistol, the pistol being of the type having a barrel and a trigger and a handle for fully receiving the follower magazine system.

Therefore, it can be appreciated that there exists a continuing need for a new and improved follower magazine system which can be used for use with a pistol of the type having a barrell and a trigger and a handle for fully receiving the follower magazine system. In this regard, the present invention as described herein substantially fulfills this need.

SUMMARY OF THE INVENTION

In view of the foregoing disadvantages inherent in the known types of magazine systems of known designs and configurations now present in the prior art, the present invention provides an improved follower magazine system. As such, the general purpose of the present invention, which will be described subsequently in greater detail, is to provide a new and improved follower magazine system and method which has all the advantages of the prior art and none of the disadvantages.

To attain this, the present invention essentially comprises a follower magazine. The magazine is in a rectilinear configuration. The magazine has an upper extent. The upper extent is positionable adjacent to a barrel. The magazine has a lower extent. The lower extent is positionable totally within a handle. The magazine also has rectangularly shaped large side faces and rectangularly shaped small front and rear faces. The front and rear faces couple the side faces. Inwardly flared flanges are spaced beneath the lower extent of the side and front and rear faces. The magazine is adapted to receive bullets. The magazine is further adapted to be positioned within the magazine.

A base plate assembly is provided. The base plate assembly has a relatively thick base plate. The base plate has a first thickness of about 0.80 inches. The base plate has a relatively thin retainer. The retainer has a second thickness of about 3/64 inches.

The base plate has a length of about 1.59 inches and a width of about 0.488 inches. The base plate has long essentially parallel side edges. The base plate has a flat rear edge and a semi-circular front edge. The base plate has a top face and a bottom face. A circular aperture is provided in proximity to the center of the base plate. Forward and rearward apertures are provided forwardly and rearwardly of the circular aperture. The base plate also has linear recesses on the bottom face adjacent to the side edges. The linear recesses extending from the rear edge to adjacent to the front edge. The recesses are adapted to receive the flanges of the side faces during operation and use.

The retainer has a length of about 1.32 inches and a width of about 0.483 inches. The retainer has long essentially parallel side edges, a flat rear edge and a semi-circular front edge. The retainer has a top face and a bottom face. A cylindrical projection is provided. The projection has an axial length of about 0.06 inches. The projection extends downwardly from the bottom face through the circular aperture of the base plate for the coupling there between. The retainer has forward and rearward apertures forwardly and rearwardly of the cylindrical projection. The apertures are in axial alignment with the forward and rearward apertures of the base plate during operation and use. The rear edge of the retainer is located forwardly about 0.40 inches from the rear edge of the base plate. The rear and front edges of the retainer are curved upwardly from the base plate. The base plate is positionable above the flanges and beneath the front and rear faces while the retainer is positionable above the base plate between the front and read faces. The base plate and the retainer are preferably fabricated of a rigid metal selected from the class of rigid metals including carbon steel and 410 stainless steel.

Provided next is a resilient spring element. The resilient spring element is within the magazine. The resilient spring element is adapted to urge bullets within the magazine upwardly toward the barrel.

Lastly provided is a follower positioned within the recess upon the resilient spring element and fabricated of a heat treated stainless steel with a polytetrafluoroethylene coating and sufficiently thin to provide a spring-like resilience. The follower has a generally rectangular central section with an L-shaped projection for positioning on the resilient spring element and with a downwardly extending front leg curved to conform to the shape of the rounded front face of the case and terminating in an arcuate lowermost extent and a downwardly extending flat rear leg to conform to the shape of the flat rear face of the case. The central section has a width of about 0.467 inches and a maximum length along the centerline of about 1.295 inches. The front leg and the central portion there adjacent are less wide than the rear leg and the central section there adjacent. The front and rear legs are adapted to smoothly slide downwardly without binding within the case with the addition of bullets to the recess and the compression of the spring and to smoothly slide upwardly without binding within the case with the removal of bullets from the case and the force of the spring. The lower end of the rear leg has a 180 degree bend with an upwardly extending portion terminating in an inwardly extending portion overlying the central portion with a supplemental bend between the upwardly extending portion and inwardly extending portion of between about 100 degrees and 105 degrees when not compressed but with the inwardly extending portion resiliently movable into facing contact with the central portion when bullets are positioned within the recess. The inwardly extending portion has a width of about 0.467 inches and a maximum length along the centerline of about 1.17 inches.

The inwardly extending portion has a generally rectangular lateral projection with a length of about 0.31 inches and a width of about 0.008 inches in proximity to the front leg. The central section has an angled edge of about 35 degrees with respect to the centerline in proximity to the front leg beneath the lateral projection.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved follower magazine system which has all of the advantages of the prior art magazine systems of known designs and configurations and none of the disadvantages.

It is another object of the present invention to provide a new and improved follower magazine system which may be easily and efficiently manufactured and marketed.

It is further object of the present invention to provide a new and improved follower magazine system which is of durable and reliable constructions.

An even further object of the present invention is to provide a new and improved follower magazine system which is susceptible of a low cost of manufacture with regard to both materials and labor, and which accordingly is then susceptible of low prices of sale to the consuming public, thereby making such follower magazine system economically available to the buying public.

Even still another object of the present invention is to provide a follower magazine system for use with a pistol of the type having a barrel and a trigger and a handle for fully receiving the follower magazine system.

Lastly, it is an object of the present invention to provide a new and improved follower magazine having a case with a base end with a base plate and an open upper end thereby forming an interior recess. A spring has an upper end and a lower end positioned on the base plate. A follower is fabricated of metal with a polytetrafluoroethylene coating positioned within the recess upon the spring and with a central section having a downwardly extending front leg and a downwardly extending rear leg. The lower end of the rear leg has a 180 degree bend with an upwardly extending portion terminating in an inwardly extending portion overlying the central portion with a supplemental bend between the upwardly extending portion and the inwardly extending portion.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated the preferred primary embodiment of the present invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a side elevational view of the preferred embodiment of the follower magazine system constructed in accordance with the principles of the present invention.

FIG. 2 is a bottom view of the follower magazine system taken along line 2—2 of FIG. 1.

FIG. 3 is an enlarged end view taken along line 3—3 of FIG. 1.

FIG. 4 is a side elevational view of the retainer of the prior Figures.

FIG. 5 is a side elevational view of the base plate of the prior Figures.

FIG. 6 is an end view of the base plate taken along line 6—6 of FIG. 5.

FIG. 8 is a side elevational view of the follower shown in FIG. 1.

FIG. 9 is a plan view of the follower taken along line 9—9 of FIG. 8.

FIG. 10 is a front elevational view of the follower taken along line 10—10 of FIG. 8.

The same reference numerals refer to the same parts throughout the various Figures.

DESCRIPTION OF THE PREFERRED EMBODIMENT

Figure 7:
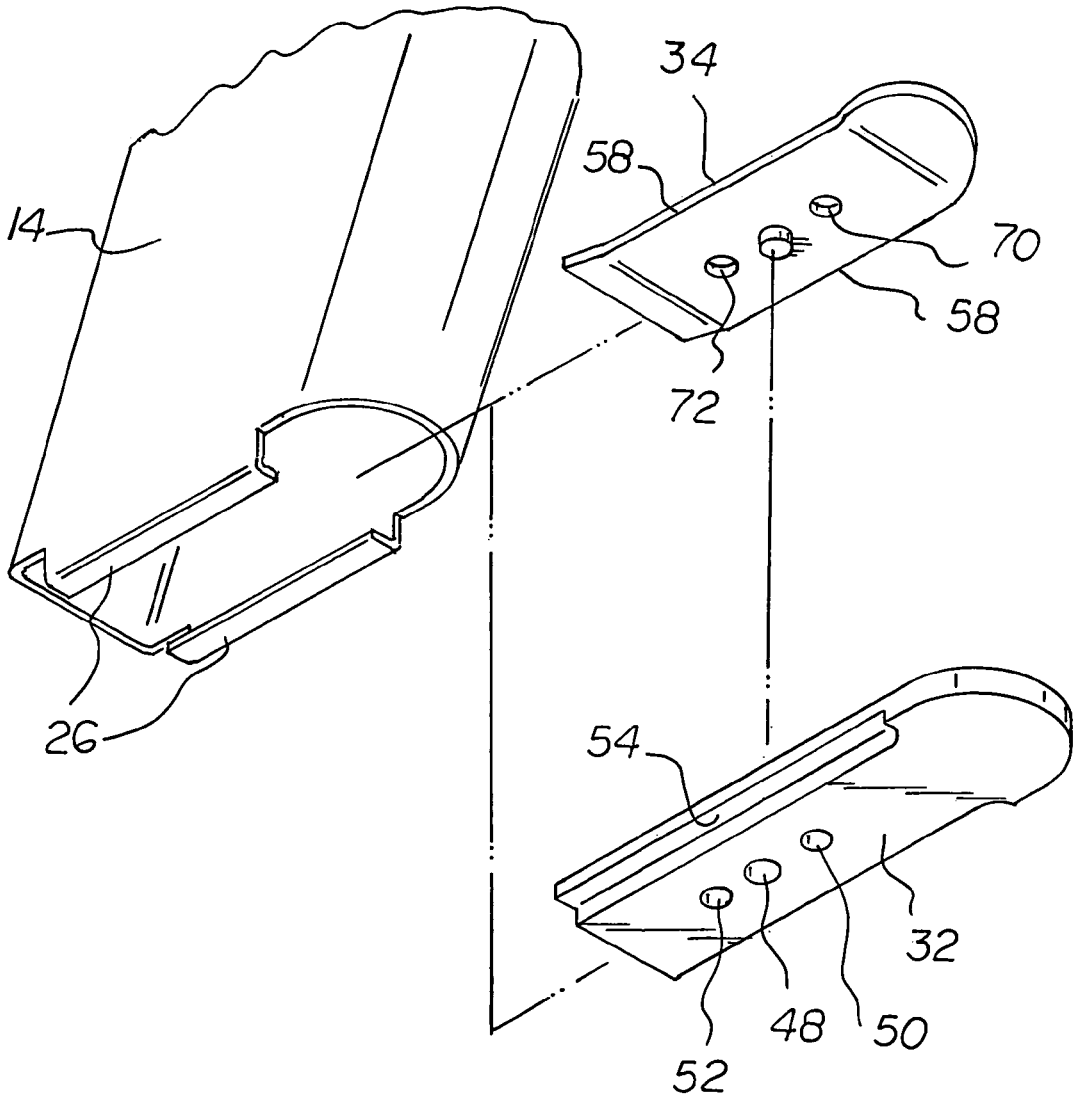
FIG. 7 is an exploded perspective illustration of the system of the prior Figures.

With reference now to the drawings, and in particular to FIG. 1 thereof, the preferred embodiment of the new and improved follower magazine system embodying the principles and concepts of the present invention and generally designated by the reference numeral 10 will be described.

The present invention, the follower magazine system 10 is comprised of a plurality of components. Such components in their broadest context include a follower magazine, a base plate assembly and a resilient element. Such components are individually configured and correlated with respect to each other so as to attain the desired objective.

First provided is a follower magazine 14. The magazine is in a rectilinear configuration. The magazine has an upper extent 16. The upper extent is positionable adjacent to a barrel. The magazine has a lower extent 18. The lower extent is positionable totally within a handle. The magazine also has rectangularly shaped large side faces 20 and rectangularly shaped small front and rear faces 22, 24. The front and rear faces couple the side faces. Inwardly flared flanges 26 are spaced beneath the lower extent of the side and front and rear faces. The magazine forms a recess which is adapted to receive bullets. The magazine is further adapted to be positioned within the magazine.

A base plate assembly 30 is provided. The base plate assembly has a relatively thick base plate 32. The base plate has a first thickness of about 0.80 inches. The base plate has a relatively thin retainer 34. The retainer has a second thickness of about 3/64 inches.

The base plate has a length of about 1.59 inches and a width of about 0.488 inches. The base plate has long essentially parallel side edges 38. The base plate has a flat rear edge 40 and a semi-circular front edge 42. The base plate has a top face 44 and a bottom face 46. A circular aperture 48 is provided in proximity to the center of the base plate. Forward and rearward apertures 50, 52 are provided forwardly and rearwardly of the circular aperture. The base plate also has linear recesses 54 on the bottom face adjacent to the side edges. The linear recesses extending from the rear edge to adjacent to the front edge. The recesses are adapted to receive the flanges of the side faces during operation and use.

The retainer has a length of about 1.32 inches and a width of about 0.483 inches. The retainer has long essentially parallel side edges 58, a flat rear edge 60 and a semi-circular front edge 62. The retainer has a top face 64 and a bottom face 66. A cylindrical projection 68 is provided. The projection has an axial length of about 0.06 inches. The projection extends downwardly from the bottom face through the circular aperture of the base plate for the coupling there between. The retainer has forward and rearward apertures 70, 72 forwardly and rearwardly of the cylindrical projection. The apertures are in axial alignment with the forward and rearward apertures of the base plate during operation and use. The rear edge of the retainer is located forwardly about 0.40 inches from the rear edge of the base plate. The rear and front edges of the retainer are curved upwardly from the base plate.

When the base plate assembly has its retainer positioned with its cylindrical projection extending downwardly into the circular aperture of the base plate, the assembly is slid into position at the bottom of the magazine. The rear edge of the retainer is held down by a user during the sliding of the assembly into position. When fully slid into position, the base plate is above the flanges and beneath the front and rear faces while the retainer is above the base plate between the front and read faces. It is held in position by the upwardly curved rear end of the base plate in contact with rear face of the magazine and upwardly curved front end of the base plate in contact with front face of the magazine. Separation of the assembly from the magazine requires the user to push the cylindrical projection upwardly out of the circular aperture where after the base plate my be slid out of the magazine.

The preferred material for the base plate and the retainer is a rigid metal selected from the class of rigid metals including carbon steel and 410 stainless steel.

Provided next is a resilient spring element 76. The resilient element is within the magazine. The resilient spring element is adapted to urge bullets within the magazine upwardly toward the barrel.

Lastly, a follower 82 is positioned within the recess upon the resilient spring element. The follower is fabricated of a heat treated metal with a polytetrafluoroethylene coating and sufficiently thin to provide a spring-like resilience. The preferred metal is 410 stainless steel. The preferred polytetrafluoroethylene coating is Teflon. Teflon is a trademark of E. I. DU PONT DE NEMOURS AND COMPANY CORPORATION of Wilmington, Del. The combination of the specific 410 stainless steel and Teflon coating provide a surprisingly superior combination of strength and lubriciousness.

The follower has a generally rectangular central section 84 with an L-shaped projection for positioning on the resilient spring element. The central section also has a downwardly extending front leg 86 curved to conform to the shape of the rounded front face of the case and terminating in an arcuate lowermost extent. The central section also has a downwardly extending flat rear leg 88 curved to conform to the shape of the flat rear face of the case. The central section has a width of about 0.467 inches and a maximum length along the centerline of about 1.295 inches. The front leg and the central portion there adjacent is less wide than the rear leg and the central section there adjacent. The front and rear legs are adapted to smoothly slide downwardly without binding within the case with the addition of bullets to the recess and the compression of the spring and to smoothly slide upwardly without binding within the case with the removal of bullets from the case and the force of the spring.

The lower end of the rear leg has a 180 degree bend with an upwardly extending portion 90 terminating in an inwardly extending portion 92 overlying the central portion. There is a supplemental bend between the upwardly extending portion and inwardly extending portion of between about 100 degrees and 105 degrees when not compressed but with the inwardly extending portion resiliently movable into facing contact with the central portion when bullets are positioned within the recess.

The inwardly extending portion has a width of about 0.467 inches and a maximum length along the centerline of about 1.17 inches.

The inwardly extending portion has a generally rectangular lateral projection 94 with a length of about 0.31 inches and a width of about 0.008 inches in proximity to the front leg. The lateral projection functions as a bump out to activate the slide stop during operation and use. The central section has an angled edge 96 of about 35 degrees with respect to the centerline in proximity to the front leg beneath the lateral projection.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A follower magazine system comprising:

a case having a base end with a base plate and an open upper end thereby forming an interior recess;

a spring having an upper end and a lower end positioned on the base plate; and a follower fabricated of metal with a polytetrafluoroethylene coating positioned within the recess upon the spring and with a central section having a downwardly extending front leg and a downwardly extending tear leg, the lower end of the rear leg having a 180 degree bend with an upwardly extending portion terminating in an inwardly extending portion overlying the central section with a supplemental bend between the upwardly extending portion and the inwardly extending portion.

2. The system as set forth in claim 1 wherein the metal is 410 stainless steel and the polytetrafluoroethylene coating is TEFLON™.

3. The system as set forth in claim 1 wherein the inwardly extending portion has a generally rectangular projection in proximity to the front leg.

4. The system as set forth in claim 3 wherein the central section has an angled edge of about 35 degrees in proximity to the front leg beneath the projection.

5. A follower magazine system for use with a pistol of the type having a barrel and a trigger and a handle for fully receiving the follower magazine system comprising, in combination:

a follower magazine in a rectilinear configuration having an upper extent positionable adjacent to a barrel and a lower extent positionable totally within a handle, the magazine also having rectangularly shaped large side faces and rectangularly shaped small front and rear faces coupling the side faces and with inwardly flared flanges spaced beneath the lower extent of the side and front and rear faces, the magazine forming a recess adapted to receive bullets and also adapted to be positioned within the magazine;

a base plate assembly having a relatively thick base plate with a first thickness of about 0.80 inches, 2.032 centimeters, and a relatively thin retainer with a second thickness of about 0.046875 inches, 3/64 inches, 0.11906 centimeters;

the base plate having a length of about 1.59 inches, 4.03860 centimeters, and a width of about 0.488 inches, 0.12395 centimeters, with long essentially parallel side edges and a flat rear edge and a semi-circular front edge, the base plate having a top face and a bottom face with a circular aperture therethrough in proximity to center thereof and with forward and rearward apertures forwardly and rearwardly of the circular aperture, the base plate also having linear recesses on the bottom face adjacent to the side edges extending from the rear edge to adjacent to the front edge, the recesses adapted to receive the flanges of the side faces during operation and use;

the retainer having a length of about 1.32 inches, 3.35280 centimeters, and a width of about 0.483 inches, 1.22682 centimeters, with long essentially parallel side edges and a flat rear edge and a semi-circular front edge, the retainer having a top face and a bottom face with a cylindrical projection having an axial length of about 0.06 inches, 0.15240 centimeters, extending downwardly from the bottom face through the circular aperture of the base plate for coupling therebetween, the retainer having forward and rearward apertures forwardly and rearwardly of the cylindrical projection in axial alignment with the forward and rearward apertures of the base plate during operation and use, the rear edge of the retainer being located forwardly about 0.40 inches, 1.01600 centimeters, from the rear edge of the base plate with the rear and front edges of the retainer being curved upwardly from the base plate, the base plate being positionable above the flanges and beneath the front and rear faces while the retainer is positionable above the base plate between the front and rear faces, the base plate and the retainer being fabricated of a rigid metal selected from the class of rigid metals including carbon steel and 410 stainless steel; and a resilient spring element within the magazine forming a recess adapted to urge bullets within the magazine upwardly toward the barrel; and a follower positioned within the recess upon the resilient spring element and fabricated of a heat-treated stainless steel with a polytetrafluoroethylene coating and sufficiently thin to provide a springy resilience, the follower having a generally rectangular central section with an L-shaped projection for positioning on the resilient spring element and with a downwardly extending front leg curved to conform to the shape of the rounded front face of the magazine and terminating in an arcuate lowermost extent and a downwardly extending flat rear leg to conform to the shape of the rear face of the magazine, the central section has a width of about 0.467 inches, 1.18618 centimeters, and a maximum length along a centerline of about 1.295 inches, 3.28930 centimeters, the front leg and the central portion adjacent thereto being less wide than the rear leg and the central section adjacent thereto, the front and rear legs adapted to smoothly slide downwardly without binding within the magazine with addition of bullets to the recess and compression of the resilient spring element and to smoothly slide upwardly without binding within the magazine with removal of bullets from the magazine and force of the resilient spring element, the lower end of the rear leg having a 180 degree bend with an upwardly extending portion terminating in an inwardly extending portion overlying the central section with a supplemental bend between the upwardly extending portion and inwardly extending portion of between about 100 degrees and 105 degrees when not compressed but with the inwardly extending portion resiliently movable into facing contact with the central section when bullets are positioned within the recess, the inwardly extending portion having a width of about 0.467 inches, 1.18618 centimeters, and a maximum length along the centerline of about 1.17 inches, 2.97180 centimeters, the inwardly extending portion having a generally rectangular lateral projection with a length of about 0.31 inches, 0.78740 centimeters, and a width of about 0.008 inches, 0.02032 centimeters, in proximity to the front leg, the central section having an angled edge of about 35 degrees with respect to the centerline in proximity to the front leg beneath the lateral projection.

* * * * *